US009383151B2

(12) United States Patent
Ballard

(10) Patent No.: US 9,383,151 B2
(45) Date of Patent: Jul. 5, 2016

(54) MAGAZINE WITH TILT-RESISTANT FOLLOWER

(71) Applicant: Pro Mag Mfg., Inc., Phoenix, AZ (US)

(72) Inventor: Michael Wayne Ballard, Surprise, AZ (US)

(73) Assignee: PRO MAG MFG., INC., Phoenix, AZ (US)

( * ) Notice: Subject to any disclaimer, the term of this patent is extended or adjusted under 35 U.S.C. 154(b) by 0 days.

(21) Appl. No.: 14/487,038

(22) Filed: Sep. 15, 2014

(65) Prior Publication Data

US 2016/0076841 A1 Mar. 17, 2016

(51) Int. Cl.
*F41A 9/65* (2006.01)

(52) U.S. Cl.
CPC ..... *F41A 9/65* (2013.01)

(58) Field of Classification Search
CPC ..... F41A 9/54; F41A 9/56; F41A 9/61; F41A 9/65; F41A 9/69; F41A 9/70; F41A 9/71
USPC ..... 42/49.01, 49.02, 50; 89/33.01, 89/33.1–33.25
See application file for complete search history.

(56) References Cited

U.S. PATENT DOCUMENTS

| | | | | |
|---|---|---|---|---|
| 2,014,177 | A * | 9/1935 | Herlach et al. | 89/33.2 |
| 2,380,083 | A * | 7/1945 | Spagnolo | 42/18 |
| 4,219,953 | A * | 9/1980 | Musgrave | 42/1.02 |
| 4,589,218 | A | 5/1986 | Teppa | |
| 4,614,052 | A * | 9/1986 | Brown et al. | 42/87 |
| 4,977,815 | A * | 12/1990 | Stephens | 89/180 |
| 5,235,769 | A * | 8/1993 | Stead et al. | 42/11 |
| 5,456,153 | A * | 10/1995 | Bentley et al. | 89/33.02 |
| D593,635 | S | 6/2009 | Fitzpatrick et al. | |
| D600,303 | S | 9/2009 | Fitzpatrick et al. | |
| D614,719 | S | 4/2010 | Fitzpatrick et al. | |
| 7,806,293 | B2 | 10/2010 | Altieri et al. | |
| 7,908,780 | B2 | 3/2011 | Fitzpatrick et al. | |
| 8,069,601 | B1 | 12/2011 | Fitzpatrick et al. | |
| 8,635,796 | B2 | 1/2014 | Fitzpatrick et al. | |
| 2011/0173857 | A1 * | 7/2011 | Hogan, Jr. | 42/50 |

OTHER PUBLICATIONS

Ddawson, "Army's Improved Magazine Increases Weapons Reliability: 'Tan is the Plan' for the New Magazine," Published Dec. 14, 2009. Accessed Aug. 4, 2014 at http://peosoldier.armylive.dodlive.mil/2009/12/14/armys-improved-magazine-increases-weapons-reliability-tan-is-the-plan-for-the-new-magazine/.

* cited by examiner

*Primary Examiner* — Bret Hayes
(74) *Attorney, Agent, or Firm* — Bennett K. Langlotz; Langlotz Patent & Trademark Works, Inc.

(57) ABSTRACT

Magazines with tilt-resistant followers have a tubular body defining a passage, a follower movable within the passage, and the follower including a roller. The follower may have rollers on the front and the rear. The follower may have two rollers on at least one of the front and the rear. The follower may have a platform portion, a tine extending perpendicular to platform portion, a roller connected proximate to the platform, and a second roller connected proximate to a free end of the tine. The follower may have front and rear tines, each tine having a pair of rollers. The tubular body may define a major plane, and the roller may define a roller axis perpendicular to the major plane. The follower may define a transverse aperture receiving a pin, and the roller may be supported on the pin. The roller may include a set of ball bearings.

18 Claims, 15 Drawing Sheets

MAGAZINE WITH TILT-RESISTANT FOLLOWER

FIELD OF THE INVENTION

The present invention relates to firearms, and more particularly to a magazine with a tilt-resistant follower.

BACKGROUND OF THE INVENTION

A magazine is an ammunition storage and feeding device within, or attached to, a repeating firearm. The magazine functions by moving the cartridges stored in the magazine into a position where they may be chambered by the action of the firearm. Most magazines designed for use with a reciprocating bolt firearm utilize a set of feed lips which stops the vertical motion of the cartridges out of the magazine but allows one cartridge at a time to be pushed forward (stripped) out of the feed lips by the firearm's bolt into the chamber.

Some form of spring and follower combination is almost always used to feed cartridges to the lips, which can be located either in the magazine (most removable box magazines) or built into the firearm (fixed box magazines). A box (or "stick") magazine, the most popular type of magazine in modern rifles and handguns, stores cartridges in a straight or gently curved column, either one above the other or staggered zigzag fashion. As the firearm cycles, cartridges are moved to the top of the magazine by a follower driven by spring compression to either a single feed position or alternating feed positions. In most firearms, the magazine follower engages a slide-stop to hold the slide back and keep the firearm out of battery when the magazine is empty and all rounds have been fired. Box magazines may be integral to the firearm or removable.

A detachable box magazine is a self-contained mechanism capable of being loaded or unloaded while detached from the host firearm. They are inserted into a magazine well in the firearm receiver usually below the action, but occasionally positioned to the side or on top. When the magazine is empty, it can be detached from the firearm and replaced by another full magazine. This significantly speeds the process of reloading, allowing the operator quick access to ammunition. This type of magazine may be straight or curved, the curve being necessary if the rifle uses rimmed ammunition or ammunition with a tapered case.

Although a conventional spring and follower combination is usually a reliable mechanism for feeding cartridges to the feed lips, occasionally conventional followers can tilt. A tilted follower can cause the cartridges in the magazine to jam or misfeed, which results in an extremely dangerous situation because the firearm cannot chamber additional cartridges until the problem is corrected.

Two existing approaches to preventing tilting followers are the follower disclosed in U.S. Pat. No. 7,908,780 to Fitzpatrick et al. and the 5.56 mm 30 round Improved Magazine developed by Program Executive Office Soldier of the U.S. Army. Both of these approaches rely on friction being generated between the follower and the magazine body in order to provide the anti-tilt properties. This friction between the follower and the magazine body makes the magazine vulnerable to slow feeding speeds and malfunctions if the spring weakens and/or any dust or debris is present that creates additional friction.

Therefore, a need exists for a new and improved magazine with tilt-resistant follower that utilizes minimal friction to provide the anti-tilt properties. In this regard, the various embodiments of the present invention substantially fulfill at least some of these needs. In this respect, the magazine with tilt-resistant follower according to the present invention substantially departs from the conventional concepts and designs of the prior art, and in doing so provides an apparatus primarily developed for the purpose of providing the follower with anti-tilt properties while utilizing minimal friction between the follower and the magazine body.

SUMMARY OF THE INVENTION

The present invention provides an improved magazine with tilt-resistant follower, and overcomes the above-mentioned disadvantages and drawbacks of the prior art. As such, the general purpose of the present invention, which will be described subsequently in greater detail, is to provide an improved magazine with tilt-resistant follower that has all the advantages of the prior art mentioned above.

To attain this, the preferred embodiment of the present invention essentially comprises a tubular body defining a passage, a follower movable within the passage, and the follower including a roller. The follower may have rollers on the front and the rear. The follower may have two rollers on at least one of the front and the rear. The follower may have a platform portion, a tine extending perpendicular to platform portion, a roller connected proximate to the platform, and a second roller connected proximate to a free end of the tine. The follower may have front and rear tines, each tine having a pair of rollers. The tubular body may define a major plane, and the roller may define a roller axis perpendicular to the major plane. The follower may define a transverse aperture receiving a pin, and the roller may be supported on the pin. The roller may include a set of ball bearings.

There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1:
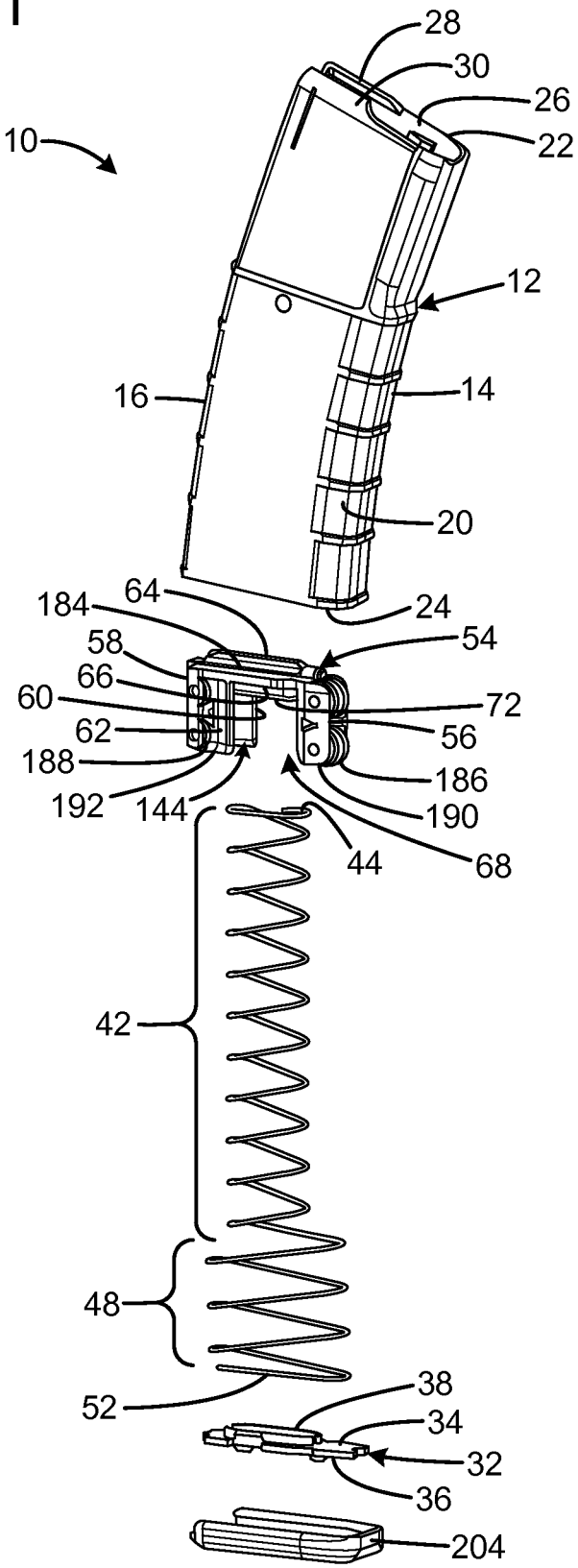
FIG. 1 is an exploded view of the current embodiment of the magazine with tilt-resistant follower constructed in accordance with the principles of the present invention.

An embodiment of the magazine with tilt-resistant follower of the present invention is shown and generally designated by the reference numeral 10.

Figure 5A:
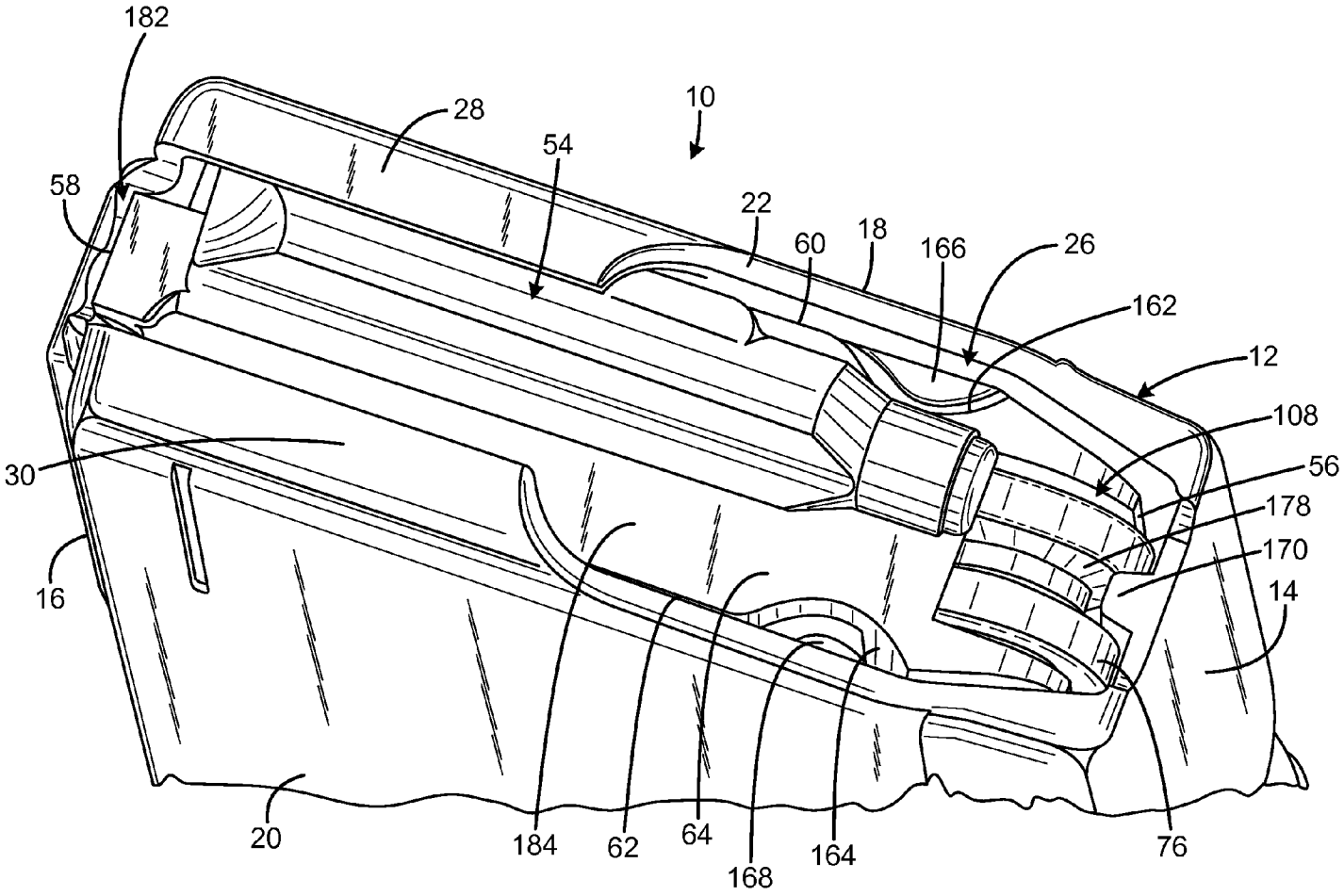
FIG. 5A is a top isometric view of the current embodiment of the magazine with tilt-resistant follower of FIG. 1.
Figure 5B:
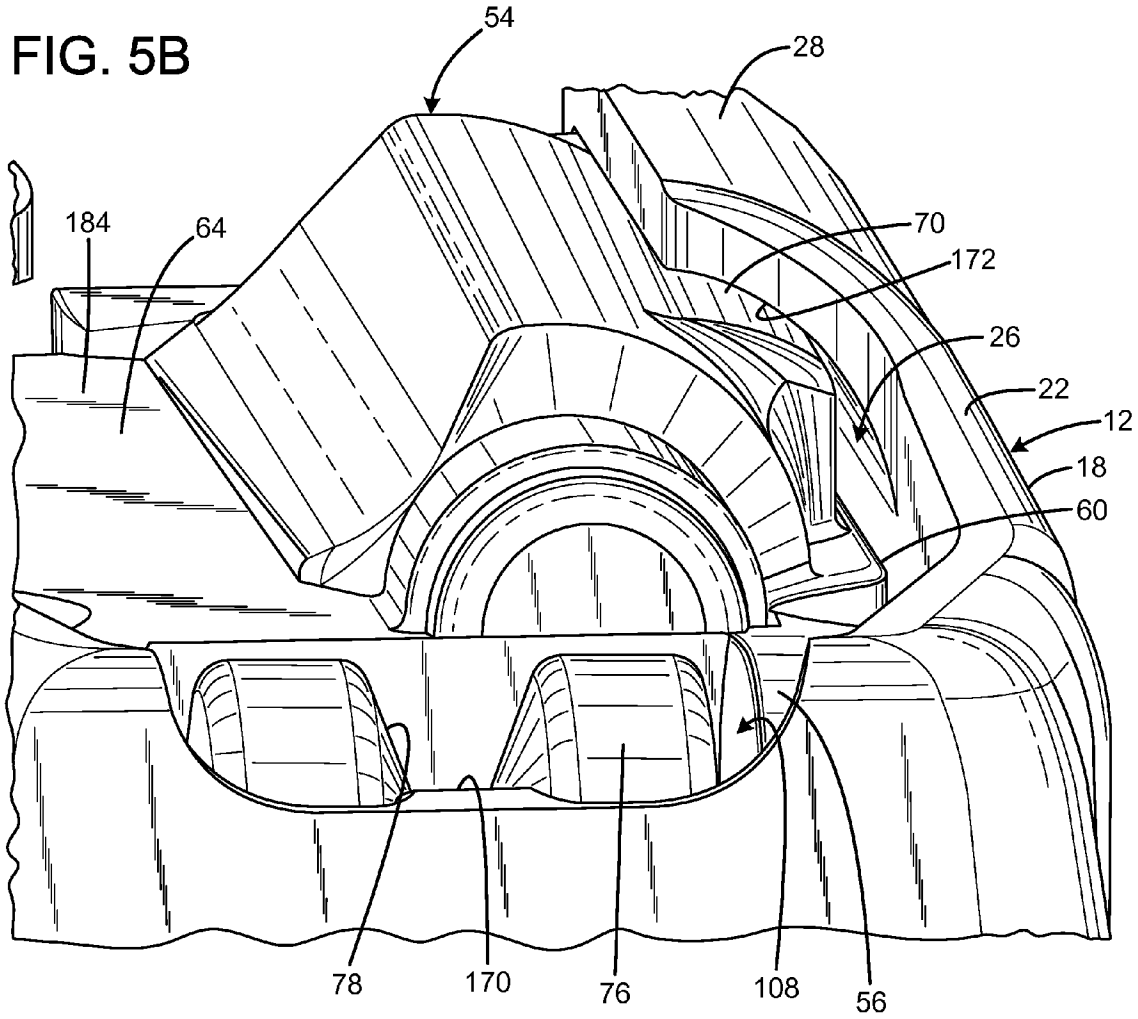
FIG. 5B is a front isometric view of the current embodiment of the magazine with tilt-resistant follower of FIG. 1.

FIG. 1 illustrates the improved magazine with tilt-resistant follower 10 of the present invention. More particularly, the magazine body 12 is generally tubular with a central bore 26, and has a front 14, rear 16, left side 18 (shown in FIG. 5A), right side 20, top 22, and bottom 24. The top rear of the body defines left and right feed lips 28, 30.

The bottom 24 of the body 12 is open to receive a follower 54, a rectangular coil spring 40, and a spring plate 32 within the central bore 26. The spring plate has a top 34 and a bottom 36. The top 34 includes an upwardly protruding spring support 38 that supports and guides the coil spring. The coil spring biases the follower towards the upper end of the body and is compressed when the magazine body is loaded with cartridges. A floor plate 204 closes the bottom end of the body and secures the follower, spring, and spring plate within the central bore of the body.

The follower 54 has a front 56, rear 58, left side 60, right side 62, top 64, and bottom 66. The follower has a central platform portion 184 with front and rear tines 186, 188 extending perpendicularly to the platform portion. The front and rear tines each have a free end 190, 192. The bottom of the follower defines a funnel guide 68 that bifurcates the underside of the follower. The rear of the funnel guide defines a semi-cylindrical channel 144 to allow the coil spring 42 guide without binding within the follower. A spring support 72 extends downward into the funnel guide from the bottom of the follower to support and guide the coil spring.

The coil spring 40 has a lower enlarged portion 48 having a top 50 and a bottom 52, and a narrow portion 42 having a top 44 and a bottom 46. The upper narrow portion of the coil spring is wound smaller to fit within the funnel guide 68. The lower enlarged portion of the coil spring allows the coil spring to remain centered in relationship to the bottom of the magazine.

Figure 2A:
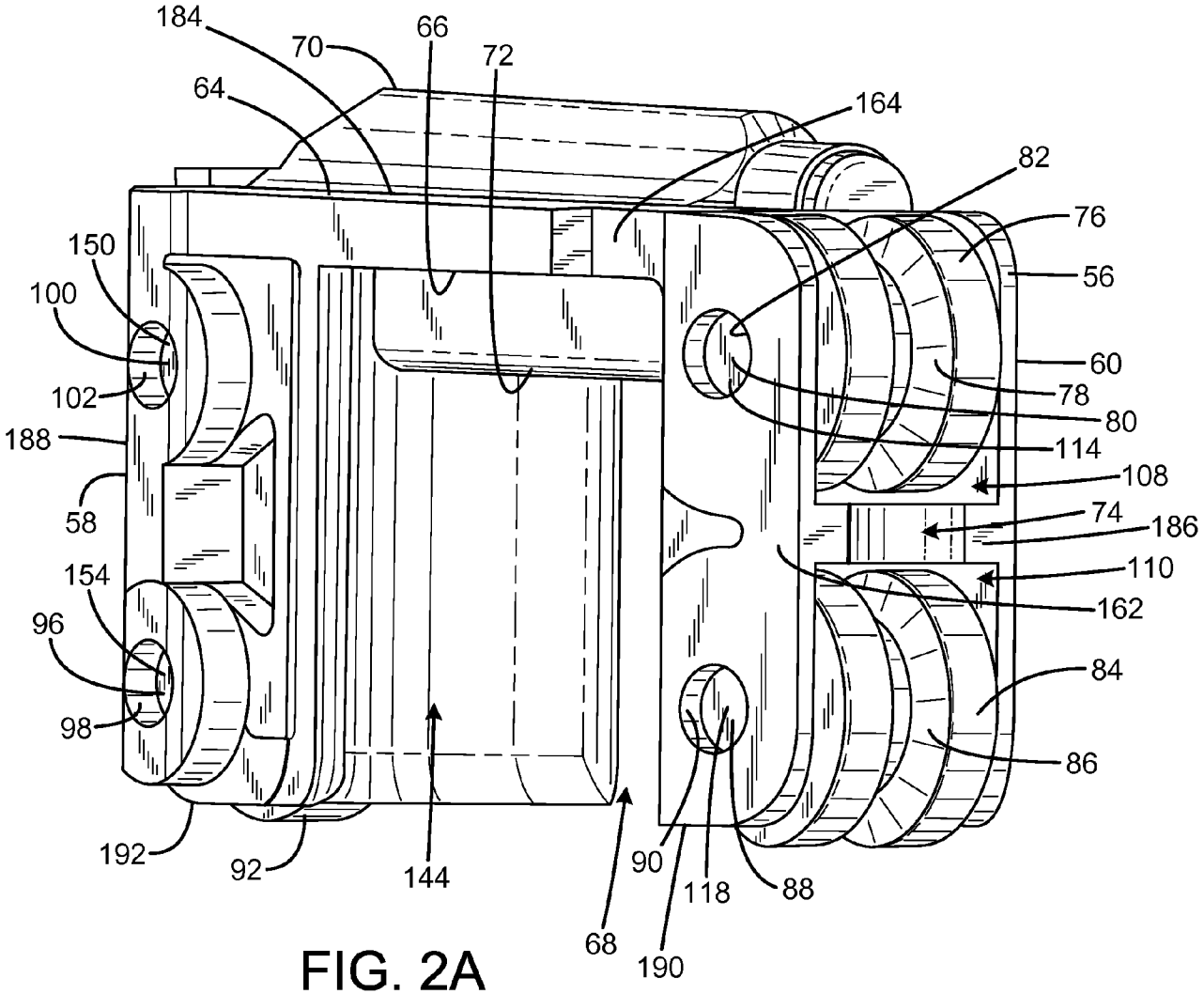
FIG. 2A is a front isometric view of the current embodiment of the follower constructed in accordance with the principles of the present invention.

FIGS. 2A-4 illustrate the improved follower 54 of the present invention. More particularly, FIGS. 2A and 3A depict the front 56 of the follower, which defines a front upper roller gap 108, a front lower roller gap 110, a front right upper axle aperture 82, a front right lower axle aperture 90, a front left upper axle aperture 104, and a front left lower axle aperture 106. The front upper axle apertures are transverse, axially registered and communicate with the front upper roller gap. The front lower axle apertures are transverse, axially registered and communicate with the front lower roller gap. A front slot 74 is defined in the front of the follower between the front upper roller gap and the front lower roller gap.

Upper V rollers 76 are rotatably mounted within the front upper roller gap 108. The upper V rollers have a circumferential V groove 78, a central bore 128, a right pocket 130, and a left pocket 206 (shown in FIG. 6). The pockets receive a right front upper sealed bearing 132 with ball bearings 196 and a central bore 134 and a left front upper sealed bearing 120 with ball bearings 194 and a central bore 122. The upper V rollers and upper sealed bearings are mounted on upper front axle 80. The right end 114 of the upper front axle is received within the front right upper axle aperture 82, and the left end 112 of the upper front axle is received within the front left upper axle aperture 104.

Lower V rollers 84 are rotatably mounted within the front lower roller gap 110. The lower V rollers have a circumferential V groove 86, a central bore 140, a right pocket 142, and a left pocket 202 (shown in FIG. 9). The pockets receive a right front lower sealed bearing 136 with ball bearings 198 and a central bore 138 and a left front lower sealed bearing 124 with ball bearings 200 and a central bore 126. The lower V rollers and lower sealed bearings are mounted on lower front axle 88. The right end 118 of the lower front axle is received within the front right lower axle aperture 90, and the left end 116 of the lower front axle is received within the front left lower axle aperture 106.

In the current embodiment, the upper V rollers 76 and lower V rollers 84 are made of plastic, but they can also be made of metal. Furthermore, the upper front, lower front, upper rear, and lower rear axles 80, 88, 100, 96 are pins in the current embodiment, and the sealed bearings 120, 124, 132, and 138 are optional. Although the sealed bearings reduce the friction resulting from movement of the V rollers, the follower 54 functions acceptably with the V rollers mounted directly on the axles, or if bushings are substituted for the sealed bearings.

Figure 2B:
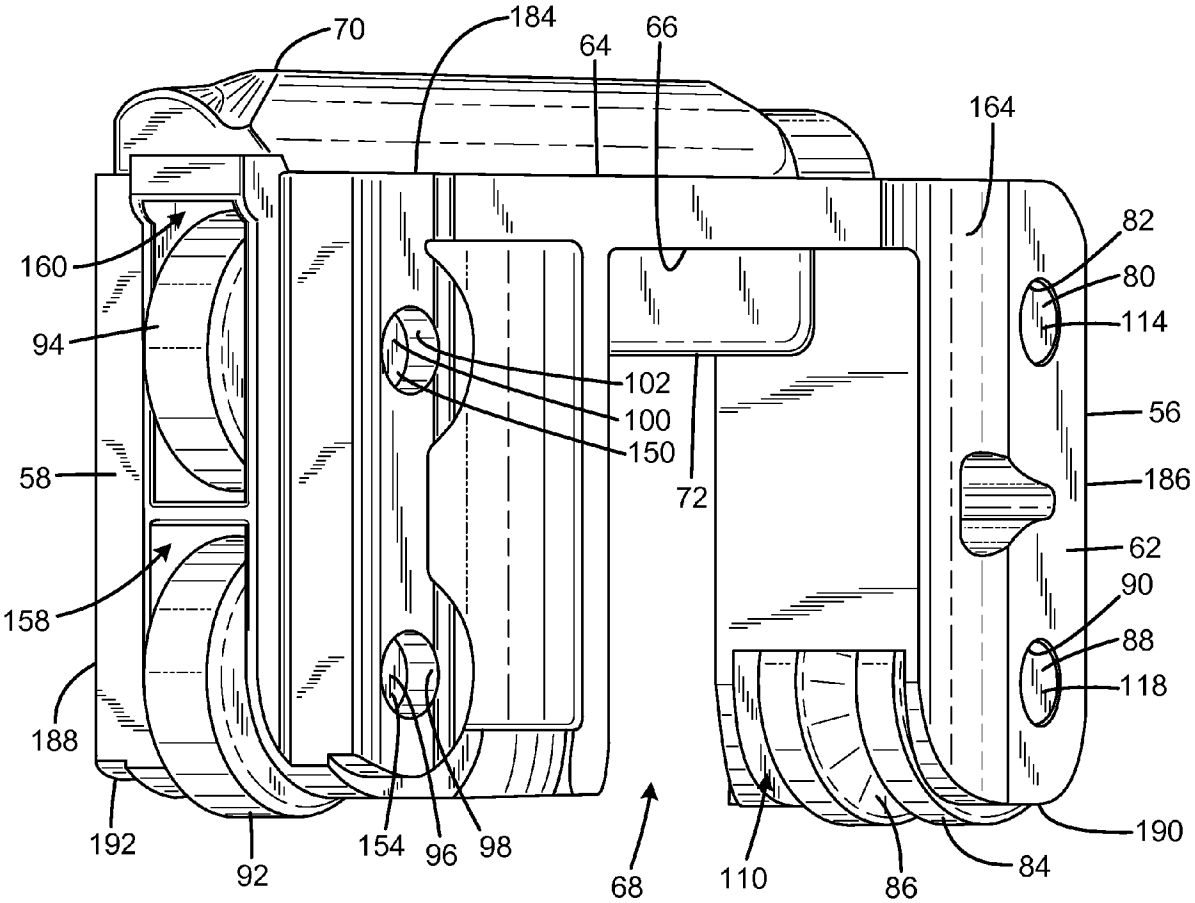
FIG. 2B is a rear isometric view of the current embodiment of the follower of FIG. 2A.
Figure 3A:
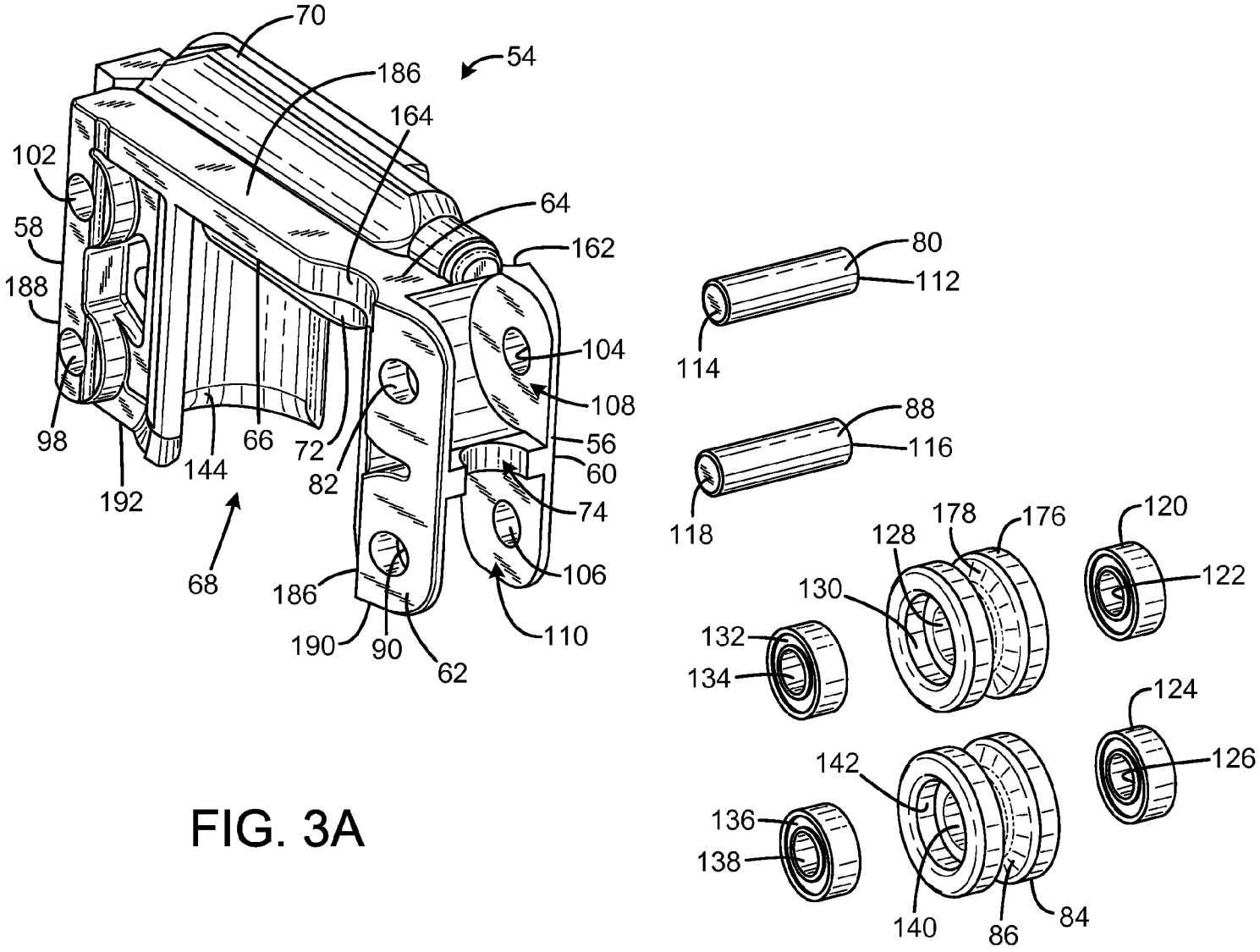
FIG. 3A is a front isometric exploded view of the current embodiment of the follower of FIG. 2A.
Figure 3B:
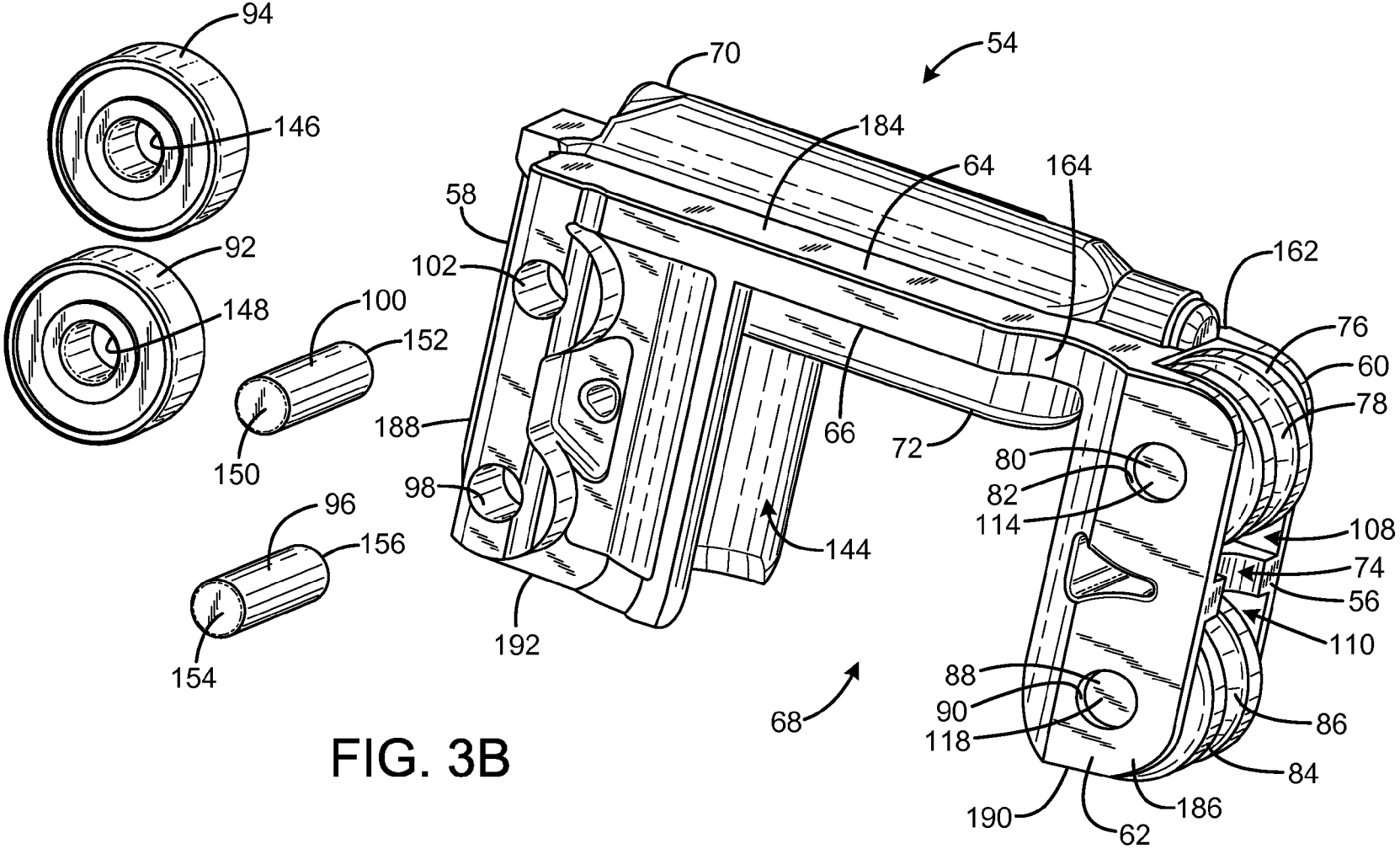
FIG. 3B is a right side isometric exploded view of the current embodiment of the follower of FIG. 2A.
Figure 4:
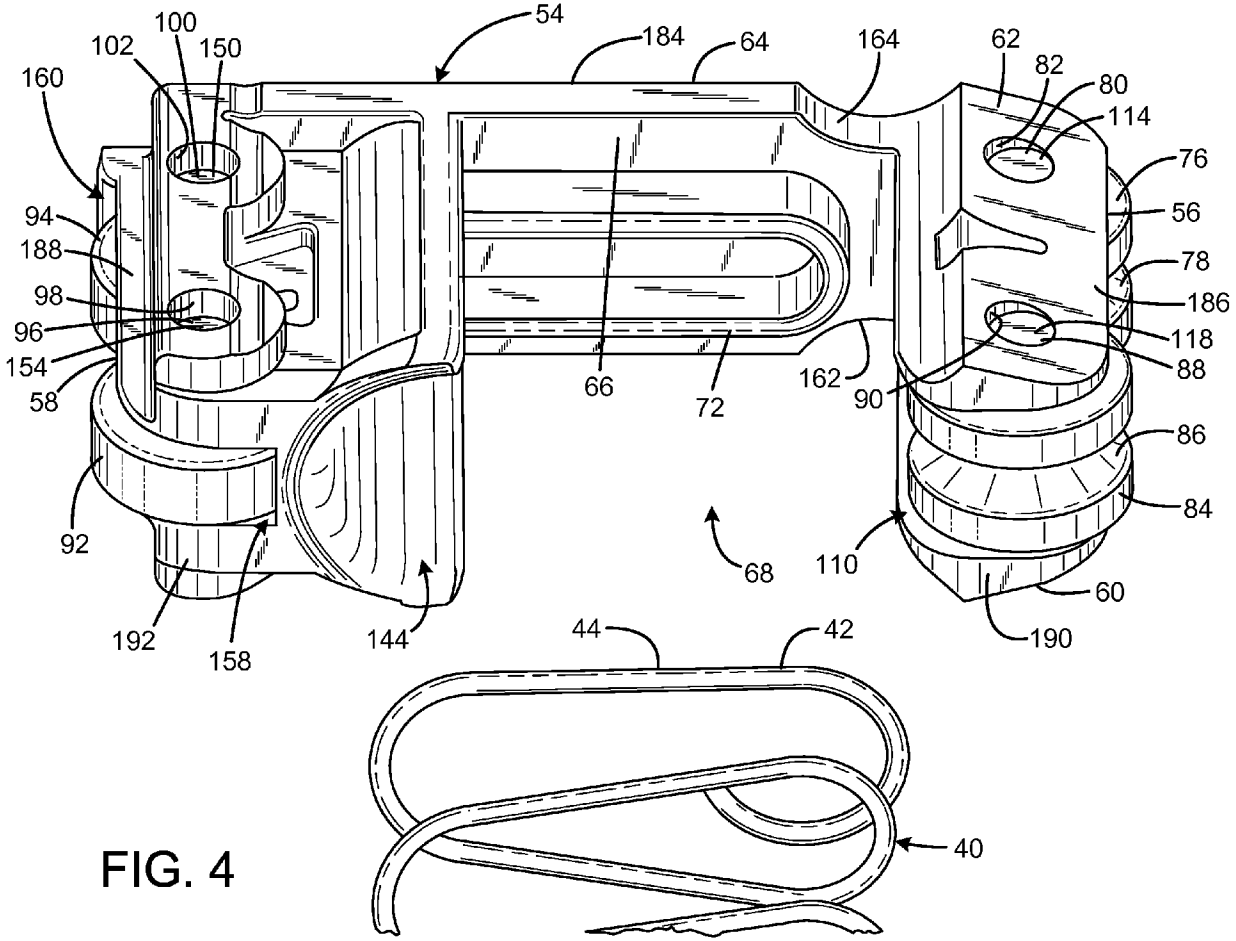
FIG. 4 is a bottom isometric view of the current embodiment of the follower of FIG. 2A with the top of the coil spring of FIG. 1.
Figure 5C:
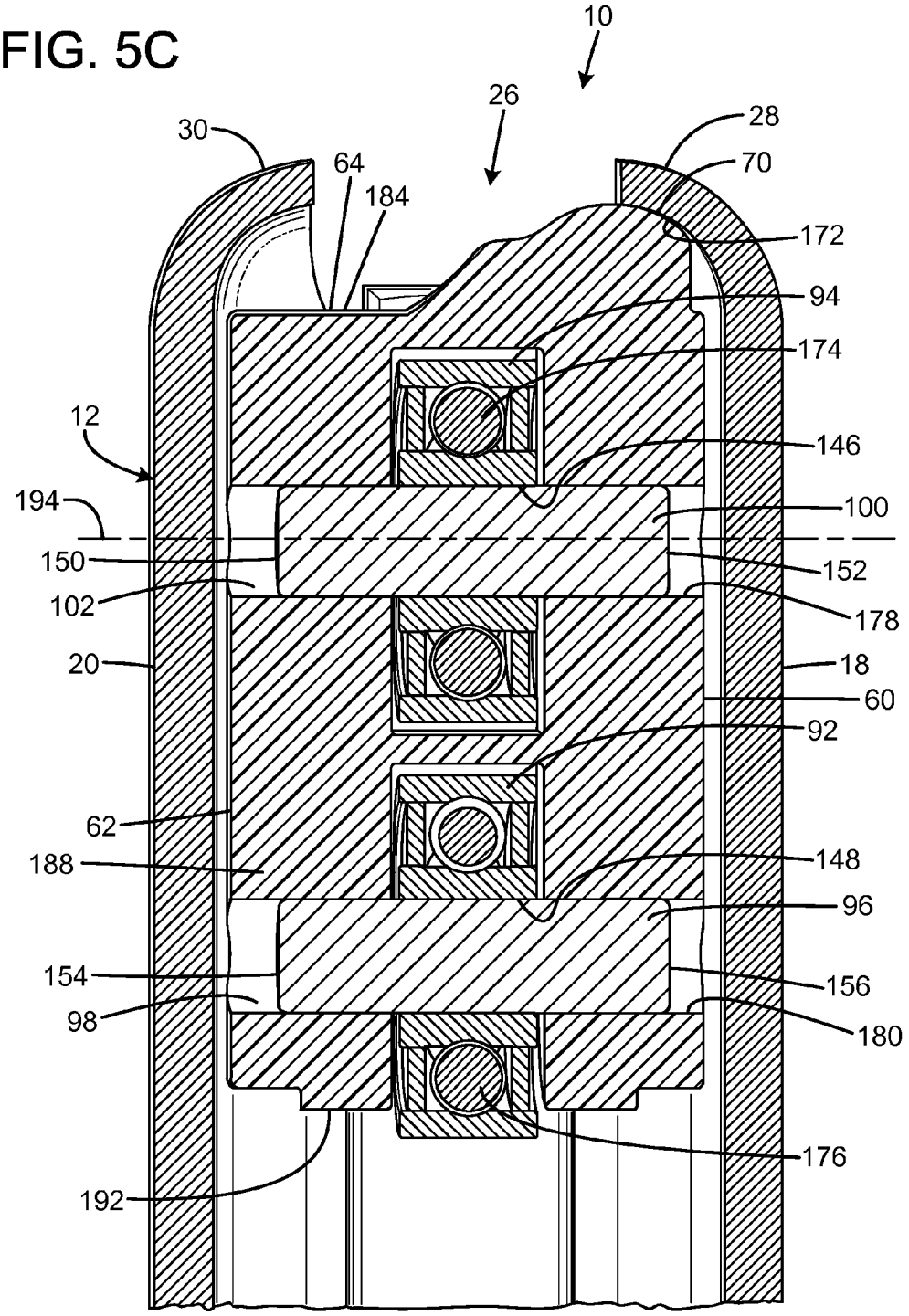
FIG. 5C is a front sectional view of the current embodiment of the magazine with tilt-resistant follower of FIG. 1.

FIGS. 2B and 3B depict the rear 58 of the follower 54, which defines a rear lower roller gap 158, a rear upper roller gap 160, a rear right lower axle aperture 98, a rear right upper axle aperture 102, a rear left upper axle aperture 178, and a rear left lower axle aperture 180 (178, 180 shown in FIG. 5C). The rear upper axle apertures are transverse, axially registered and communicate with the rear upper roller gap. The rear lower axle apertures are transverse, axially registered and communicate with the rear lower roller gap.

A rear upper roller 94 having ball bearings 174 and a central bore 146 is mounted within the rear upper roller gap 160. The rear upper roller is mounted on upper rear axle 100. The left end 152 of the upper rear axle 100 is received within the rear left upper axle aperture 178, and the right end 150 of the upper rear axle is received within the rear right upper axle aperture 102. The upper rear axle defines a roller axis 194 (shown in FIG. 5C) that is perpendicular to a major plane defined by the tubular body. A rear lower roller 92 having ball bearings 176 and a central bore 148 is mounted within the rear lower roller gap 158. The rear lower roller is mounted on lower rear axle 96. The left end 156 of the lower rear axle is received within the rear left lower axle aperture 180, and the right end 154 of the lower rear axle is received within the rear right lower axle aperture 98.

As depicted in FIG. 3A, the rear 58 of the top 64 left side 60 of the follower 54 includes a raised stop surface 70. The front 56 left side and right side 62 of the top of the follower define left and right channels 162, 164. The bottom 66 of the follower (shown in FIG. 4) includes a downwardly protruding spring support 72. The top 44 of the narrow portion 42 of the coil spring 40 receives the spring support 72, and the semi-cylindrical channel 144 in the funnel guide 68 receives the narrow portion of the coil spring. The coil spring has a narrow portion to provide clearance for the front V rollers 76, 84 and the rear rollers 92, 94.

FIGS. 5A-11 depict the interactions between the follower 54 and the magazine body 12. More particularly, the follower is illustrated at the upper limit of its range of motion. The stop surface 70 on the top 64 left side 60 of the follower is constrained from further upward movement by contact with a follower stop point 172 located on the underside of the left feed lip 28. The left and right channels 162, 164 at the front 56 left and right sides 60, 62 of the follower receive a left bullet guide 166 and a right bullet guide 168. However, the left and right channels are sized so that no direct contact occurs between the follower and the bullet guides. The bullet guides are protrusions into the central bore 26 of the magazine body. The bullet guides control bullet stack position and width. Their front portions are rounded and enlarged to add additional strength to the sidewall sections of the magazine body.

An internal front ridge or rib 170 runs the full length of the front 14 of the magazine body 12 and protrudes into the central bore 26. This type of rib has been used on many prior art magazines. For example, U.S. Pat. No. 4,589,218 to Teppa with a forward rib that clearly separates the rounds. The forward rib also guides the follower reinforces the front edge of the magazine. Most importantly, the forward rib keeps the front points of the ammunition stack separated, so the rib is essential to proper stacking and reliable feeding when the rounds are in a double column stack. All of these functions of the front rib are well-known in the art.

Figure 6:
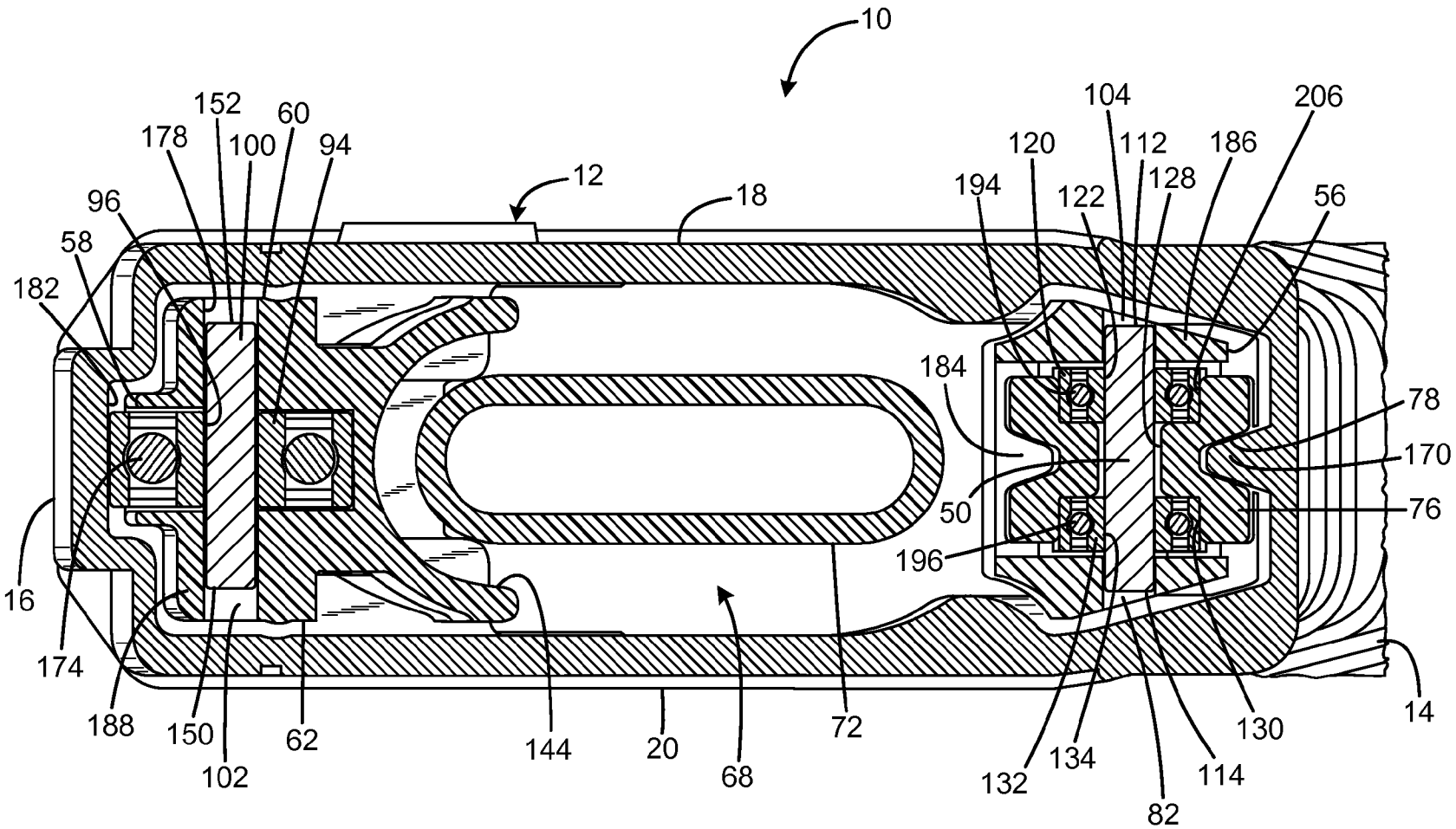
FIG. 6 is a top sectional view of the current embodiment of the magazine with tilt-resistant follower of FIG. 1
Figure 7:
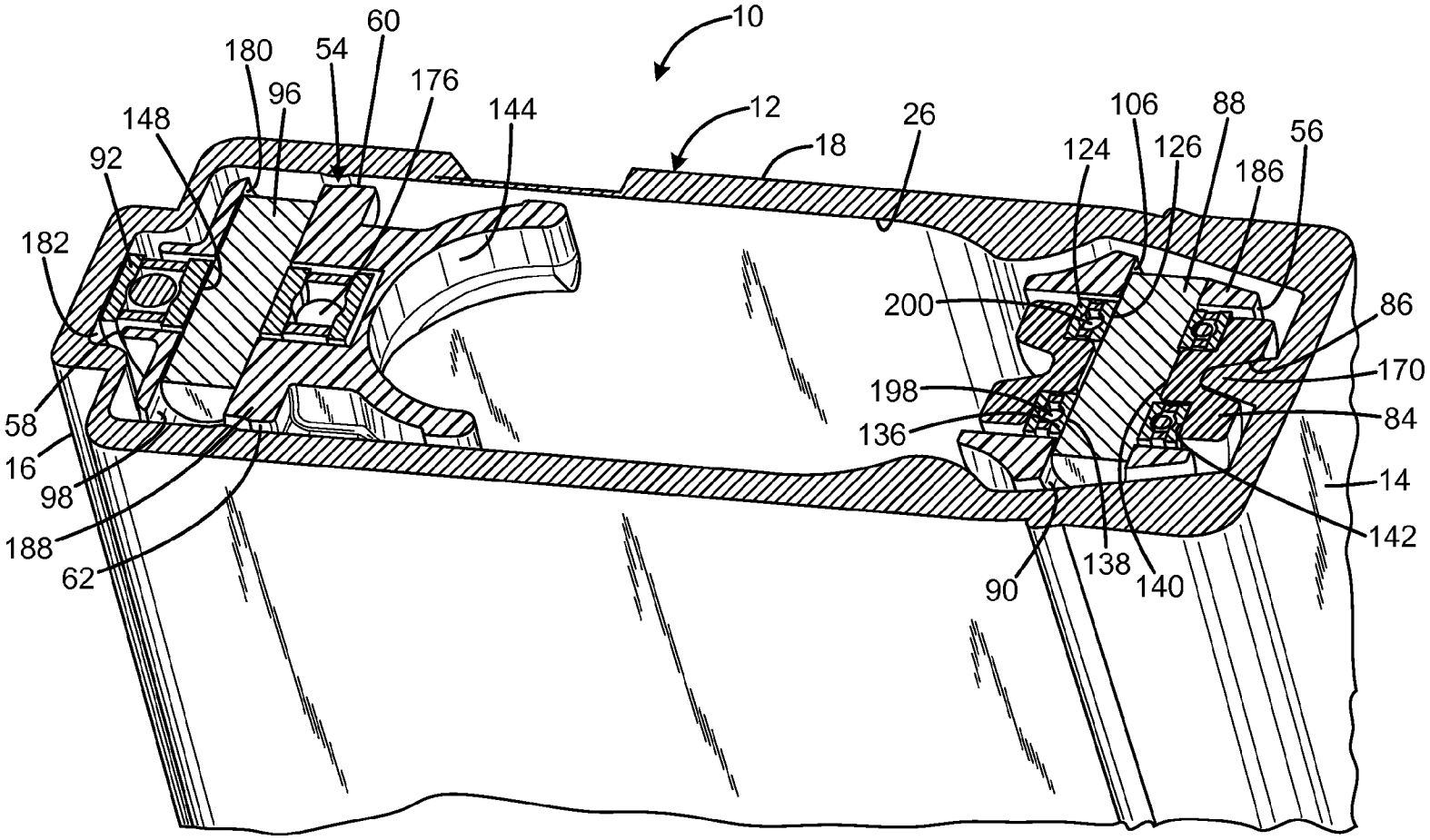
FIG. 7 is a top sectional isometric view of the current embodiment of the magazine with tilt-resistant follower of FIG. 1.
Figure 8:
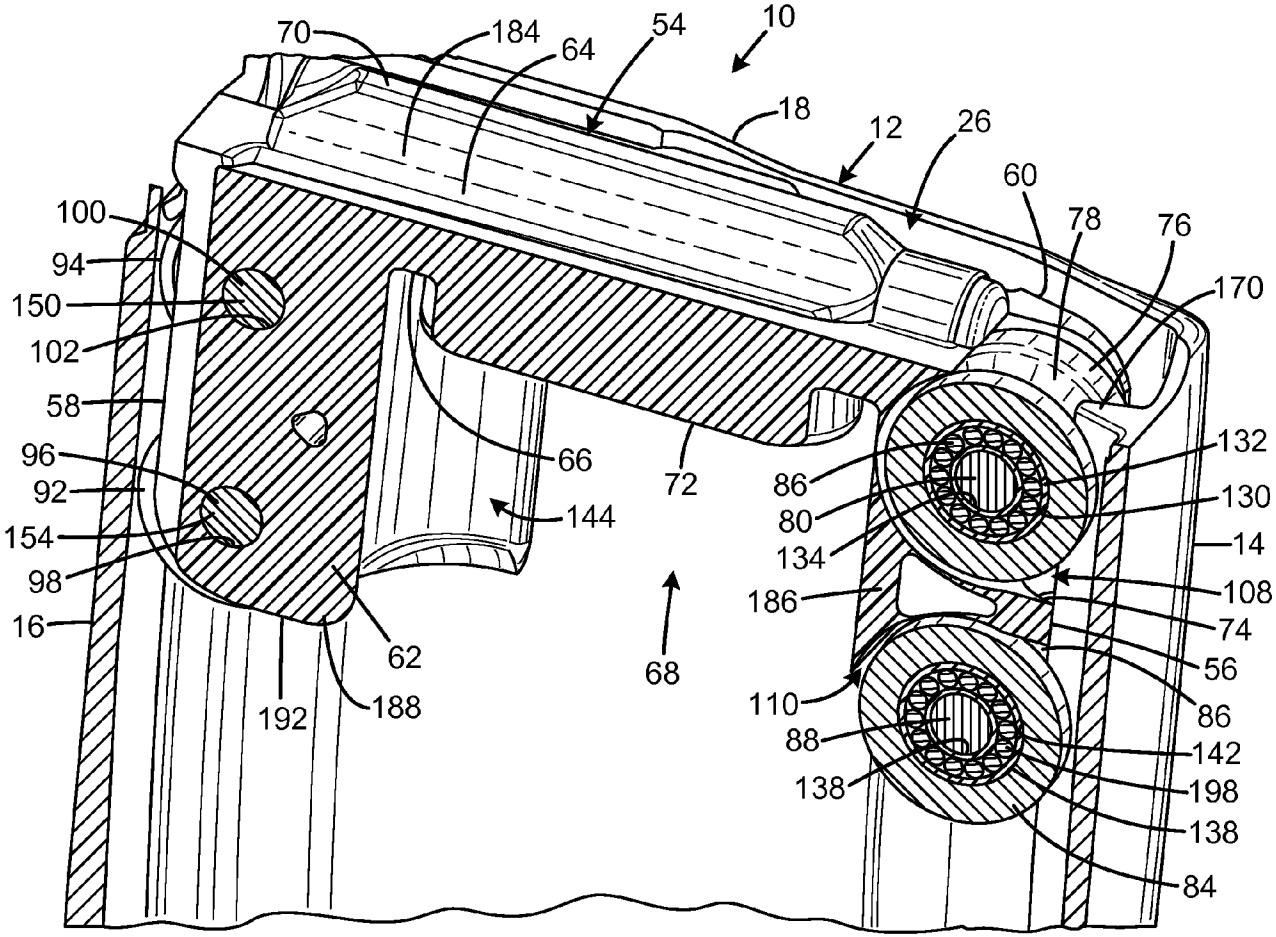
FIG. 8 is a right side sectional isometric view of the current embodiment of the magazine with tilt-resistant follower of FIG. 1.
Figure 9:
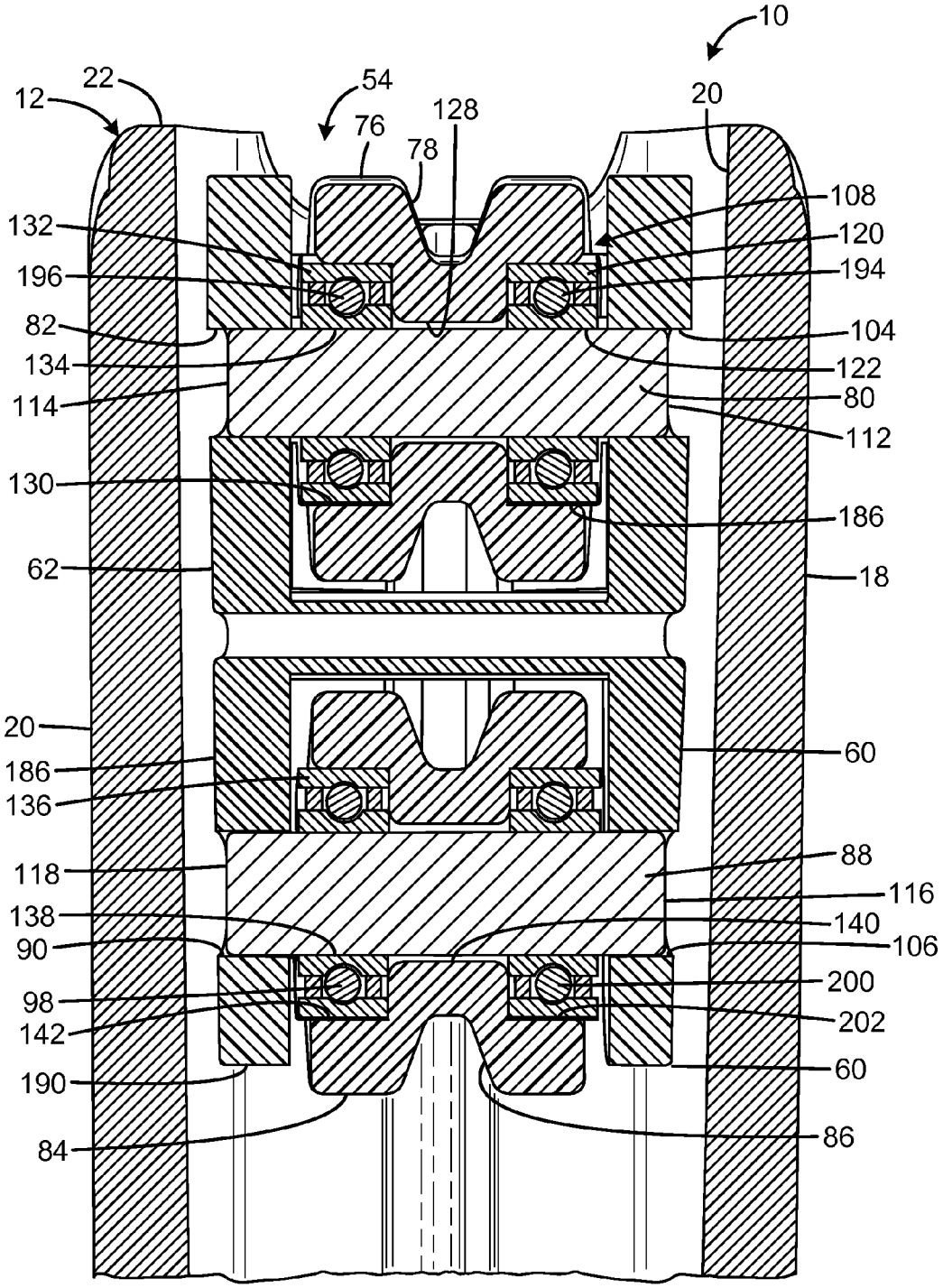
FIG. 9 is a front sectional view of the current embodiment of the magazine with tilt-resistant follower of FIG. 1.
Figure 10:
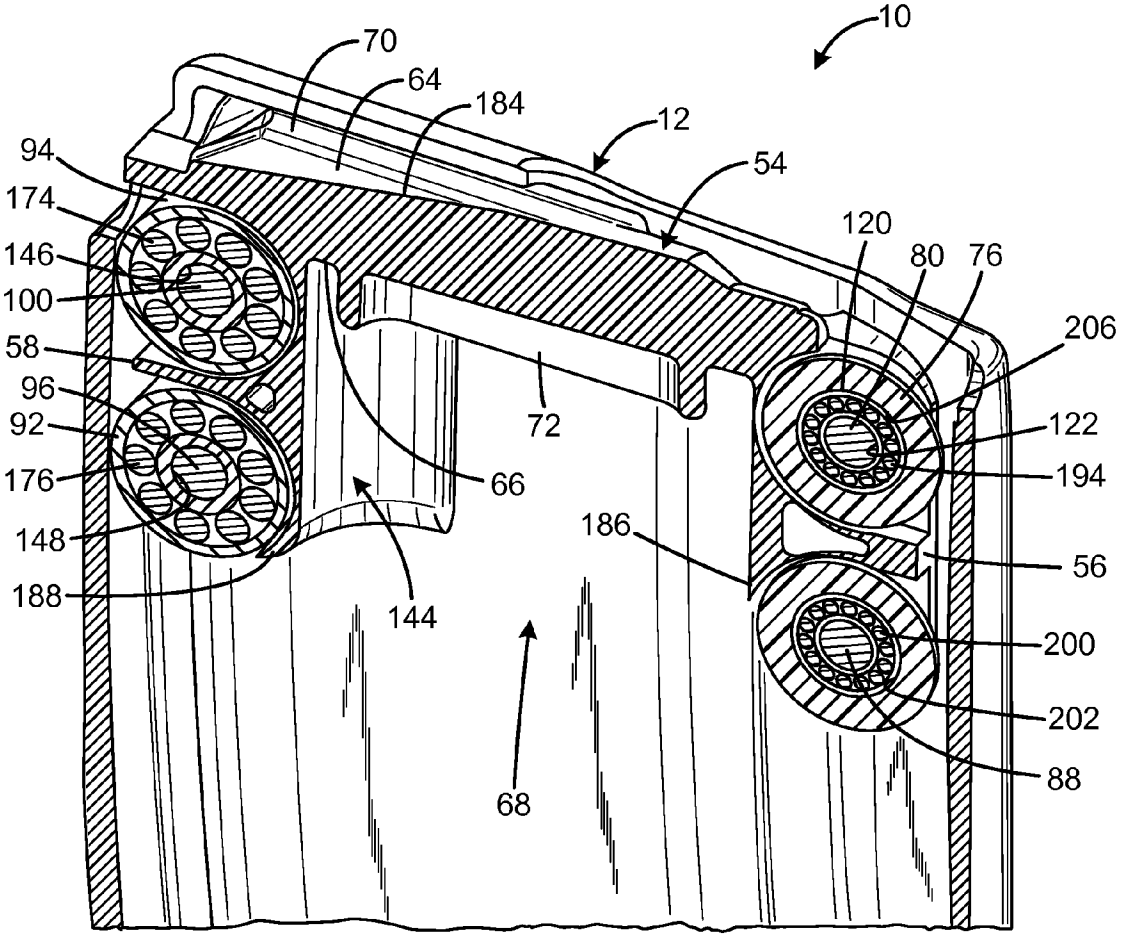
FIG. 10 is a right side sectional isometric view of the current embodiment of the magazine with tilt-resistant follower of FIG. 1.
Figure 11:
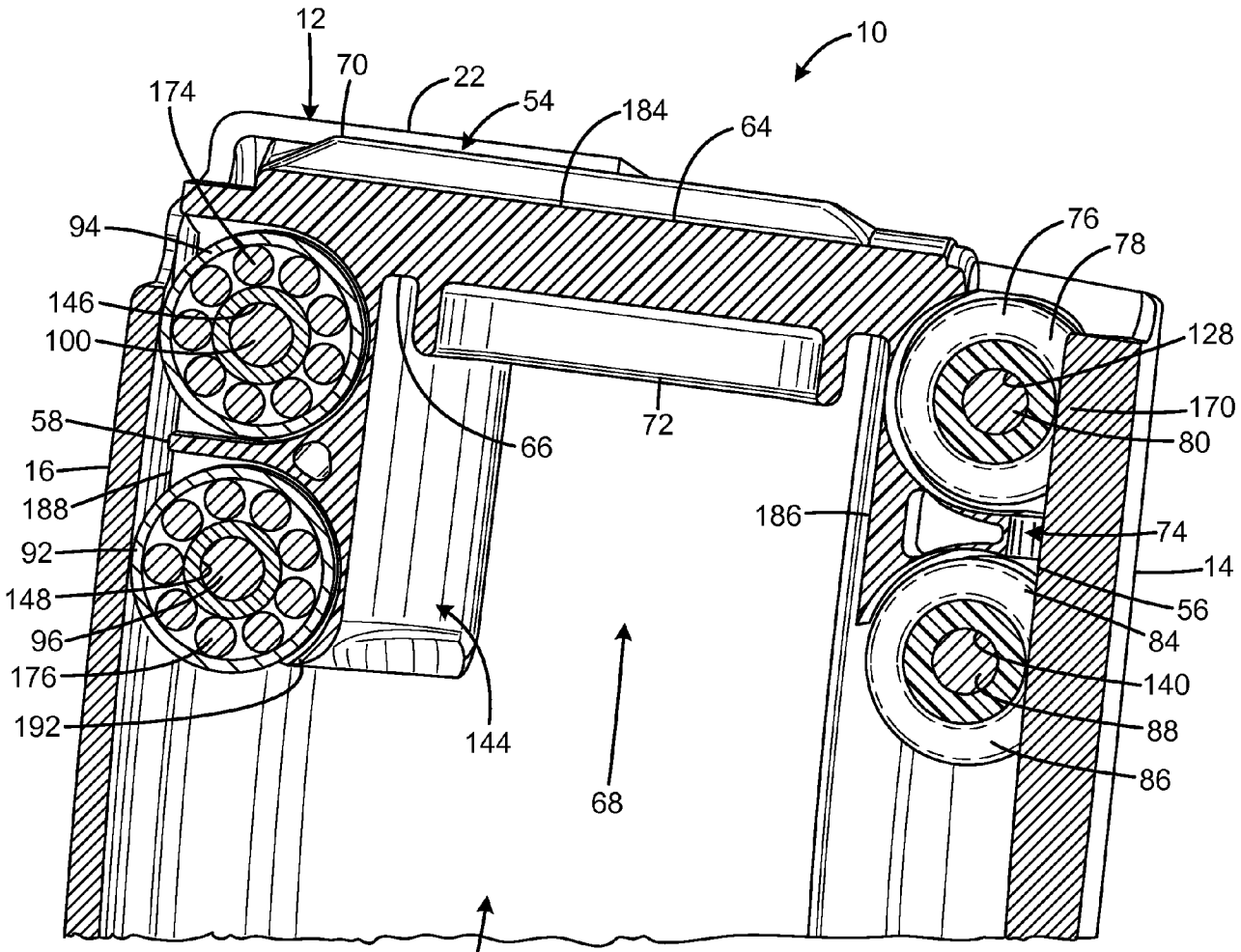
FIG. 11 is a right side sectional isometric view of the current embodiment of the magazine with tilt-resistant follower of FIG. 1.

In the current invention, the front rib 170 provides the novel function of guiding the front V rollers 76, 84 latitudinally, longitudinally, and axially with a minimum amount of friction between the front V rollers and the front rib. The V grooves 78, 86 enable the front V rollers to ride on the front rib, which provides side to side anti-tilt properties by preventing the follower 54 from scraping or rubbing on the sides of the magazine body 12. A rear channel 182 runs the full length of the rear 16 of the magazine body and enlarges the central bore 26. The rear rollers 92, 94 ride within the rear channel. The combination of the front V rollers and the rear rollers provide front to back anti-tilt properties without requiring any interfacing shapes in the follower or the left and right sides of the magazine body. As a result, the follower is prevented from tilting utilizing only minimal friction between the follower and the magazine body to provide the anti-tilt properties. FIGS. 6, 7, and 9 clearly show how the follower only contacts the magazine body with the front V rollers and the rear rollers, with no contact with the left and right sides of the magazine body.

In the context of the specification, the terms "rear" and "rearward," and "front" and "forward" have the following definitions: "rear" or "rearward" means in the direction away from the muzzle of the firearm while "front" or "forward" means it is in the direction towards the muzzle of the firearm.

While a current embodiment of a magazine with tilt-resistant follower has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A magazine comprising:

a tubular body defining a passage;

the tubular body defining a major plane and having an elongated forward wall and an opposed elongated rear wall;

a follower movable within the passage and having a forward portion proximate the forward wall and a rear portion proximate the rear wall;

the follower including a roller;

the roller defining a roller axis perpendicular to the major plane; and wherein the follower has an elongated platform portion having opposed ends and the follower has a pair of tines depending downwardly from the opposed ends of the platform portion to terminate at free ends.

2. The magazine of claim 1 further comprising:

the follower having a front and a rear; and the follower including rollers on the front and the rear.

3. The magazine of claim 2 further comprising the follower including two rollers on at least one of the front and the rear.

4. The magazine of claim 1 further comprising:

the follower having a platform portion;

the follower having a tine extending perpendicularly to platform portion;

a roller connected proximate to the platform; and a second roller connected proximate to a free end of the tine.

5. The magazine of claim 4 further comprising the follower having front and rear tines, each tine having a pair of rollers.

6. The magazine of claim 1 further comprising:

the follower defining a transverse aperture receiving a pin; and the roller being supported on the pin.

7. The magazine of claim 1 further comprising the roller including a set of ball bearings.

8. The magazine of claim 1 further comprising the roller defining a circumferential groove.

9. The magazine of claim 8 further comprising the tubular body having an internal ridge received by the circumferential groove.

10. The magazine of claim 1 wherein the tubular body defines a channel, and wherein at least a portion of the roller is received in the channel.

11. The magazine of claim 1 wherein the magazine is adapted to receive a stack of cartridges, each having a length sized to be closely received between the forward wall and rear wall of the magazine.

12. A magazine comprising:

a tubular body defining a passage;

the tubular body defining a major plane and having an elongated forward wall and an opposed elongated rear wall;

a follower movable within the passage and having a forward portion proximate the forward wall and a rear portion proximate the rear wall;

the follower having an elongated platform portion having opposed ends;

the follower having a pair of tines depending downwardly from opposed ends of the platform portion to terminate at free ends; and a plurality of rollers connected to the follower.

13. The magazine of claim 12 further comprising:

the follower having a front and a rear; and the follower including rollers on the front and the rear.

14. The magazine of claim 13 further comprising the follower including two rollers on at least one of the front and the rear.

15. The magazine of claim 12 further comprising:

the follower having a platform portion;

the follower having a tine extending perpendicularly to platform portion;

a roller connected proximate to the platform; and a second roller connected proximate to a free end of the tine.

16. The magazine of claim 15 further comprising the follower having front and rear tines, each tine having a pair of rollers.

17. The magazine of claim 12 further comprising:

the follower defining a transverse aperture receiving a pin; and the roller being supported on the pin.

18. The magazine of claim 12 further comprising the roller including a set of ball bearings.

* * * * *